US007247015B2

(12) United States Patent
Hu

(10) Patent No.: US 7,247,015 B2
(45) Date of Patent: Jul. 24, 2007

(54) HIDDEN PUSH BUTTON ARRANGEMENT FOR PIEZOELECTRIC LIGHTER

(75) Inventor: John Hu, El Monte, CA (US)

(73) Assignee: Zreative Products Inc., El Monte, CA (US)

( * ) Notice: Subject to any disclaimer, the term of this patent is extended or adjusted under 35 U.S.C. 154(b) by 273 days.

(21) Appl. No.: 10/933,739

(22) Filed: Sep. 2, 2004

(65) Prior Publication Data

US 2006/0046219 A1 Mar. 2, 2006

(51) Int. Cl.
*F23Q 7/12* (2006.01)
*F23Q 2/32* (2006.01)
*F23Q 2/08* (2006.01)

(52) U.S. Cl. ..... 431/126; 431/132; 431/255

(58) Field of Classification Search ..... 431/126, 431/131, 132, 153, 255
See application file for complete search history.

(56) References Cited

U.S. PATENT DOCUMENTS 5,171,143 A * 12/1992 Sohn ..... 431/153
6,641,391 B1 * 11/2003 Xu ..... 431/255

* cited by examiner

*Primary Examiner*—Alfred Basichas
(74) *Attorney, Agent, or Firm*—Raymond Y. Chan; David and Raymond Patent Group

(57) ABSTRACT

A piezoelectric lighter includes a lighter casing, an ignition nozzle, a gas releasing valve, a piezoelectric unit, and a hidden push button arrangement. The hidden push button arrangement includes a push button which has a pusher end portion, a pivot end portion pivotally mounted at the lighter casing at the button receiving slot thereof, and a button surface extended from the pusher end portion and the pivot end portion, adapted to pivotally fold between an operation position and a hidden position. At the hidden position, the pusher end portion of the push button is folded into the button receiving slot to align the button surface of the push button with the outer surface of the lighter casing so as to completely hide the push button in the button receiving slot within the lighter casing.

14 Claims, 5 Drawing Sheets

HIDDEN PUSH BUTTON ARRANGEMENT FOR PIEZOELECTRIC LIGHTER

BACKGROUND OF THE PRESENT INVENTION

1. Field of Invention

The present invention relates to a lighter, and more particularly to a piezoelectric lighter, wherein an actuation button is arranged to normally receive and hide in a lighter casing so as to prevent the lighter from being accidentally ignited.

2. Description of Related Arts

Lighters are widely utilized for rapidly and conveniently acquiring controlled ignition. As a matter of conventional art, basing on the respective mechanism for generating ignition, there exist two board categories of lighters, namely flint lighters and piezoelectric lighters. For both categories, the user's operation is essentially the same, i.e. the user has to push an actuation button provided on the lighter casing to ignite the lighter. Because of the ease of this actuation procedure, very often, the lighters are unintentionally or accidentally ignited by, say, a child of the lighter owner.

Therefore, handfuls of safety devices are developed to incorporate into the conventional lighters so as to prevent accidental or unintentional ignition, especially by minors who do have the capability to appreciate what might be a disastrous consequence of abusing the lighter. Those so called safety devices are founded on a general principle, that is, locking the depressive movement of the actuation button in order to prevent ignition, until the actuation button is manually unlocked, after which the lighter can then be normally ignited. As a matter of fact, the mechanism for locking the actuation buttons are indeed plentiful, most of which have achieved satisfactory outcome, at least in terms of preventing unintentional ignitions.

However, the reality is that most lighters manufacturers are somewhat driven by the commercial world so that their safety devices are largely compromised by the requirement of marketability which is usually translated into such things as convenience ignition and easy unlocking. As a result, a tension inevitably exists between marketability and the effectiveness of the safety devices, which should be pinpointed by the difficulty for unlocking the actuation button. The dilemma is that in order to achieve good marketability, it should not be too difficult for the actuation button being unlocked, at the same time however, the easier the actuation button can be unlocked, the less effective the safety device is for preventing unintentional or minor ignition.

Another inherent shortcoming of conventional lighters is that it is almost inevitable that children, and of course adults, would recognize that what is a lighter, even though the actuation button thereof is locked, and this attracts exploration of how to unlock the actuation, probably driven by human curiosity. It is submitted that, if the children do not recognize a particular physical object is actually a lighter, even though they have that lighter at hands, they may not even go on to explore how to unlock the actuation button, and it is likely that they would lose interest to that object very fast and put it aside. Of course, if their parents keep the lighter well out of the children, the chance of the children contacting the lighter would be lower, and this means the chance of the children accidentally igniting the lighter would be at best remote.

SUMMARY OF THE PRESENT INVENTION

A main object of the present invention is to provide a piezoelectric lighter comprising a push button which is adapted to normally receive in a button receiving slot on an outer surface of the lighter casing so as to prevent the push button from being accidentally ignited by undesirable people, such as minors.

Another object of the present invention is to provide a piezoelectric lighter wherein the push button is shaped and sized to align and assimilate with the outer surface of the lighter casing so as to prevent the push button from easily recognizable by undesirable people, such as minors.

Another object of the present invention is to provide a piezoelectric lighter which is safe to use, and substantially resolves the tension between operation difficulty and safety of a conventional safety lighter, so that its operation becomes convenient yet safe.

Another object of the present invention is to provide a piezoelectric lighter which does not involve expensive and complicated mechanical components, and does not significantly alter an operation of a conventional piezoelectric lighter. Therefore, the manufacturing cost as well as the ultimate selling price of the present invention can be effectively minimized.

Another object of the present invention is to provide a piezoelectric lighter, wherein because the push button can be assimilated with the lighter casing, therefore, the lighter casing can be crafted to be aesthetically sound so as to become an accessory when it is not in use.

Accordingly, in order to accomplish the above objects, the present invention provides a piezoelectric lighter, comprising:

a lighter casing which has an outer surface, a button receiving slot indently formed on the outer surface, and a fuel storage compartment provided in the lighter casing for storing liquefied gaseous fuel;

an ignition nozzle communicatively extended from the fuel storage compartment to the outer surface of the lighter casing;

a gas releasing valve communicated the fuel storage compartment with the ignition nozzle for controlling the fuel to release at the ignition nozzle when the gas releasing valve is uplifted;

a piezoelectric unit, which is received in the lighter casing, comprising a depressible part extended upwardly and a spark generation tip towards the ignition nozzle for generating a spark at the ignition nozzle to ignite the fuel at the ignition nozzle when the depressible part is depressed; and a push button arrangement, which comprises:

a push button, having an pusher end portion, a pivot end portion pivotally mounted at the lighter casing at the button receiving slot thereof, and a button surface extended from the pusher end portion and the pivot end portion, adapted to pivotally fold between an operation position and a hidden position, wherein at the operation position, the pusher end portion of the push button is upwardly folded above the outer surface of the lighter casing to align the pivot end portion of the push button with the depressible part of the piezoelectric unit such that the pusher end portion of the push button is adapted to be depressed to depress the depressible part of the piezoelectric unit for ignition, and at the hidden position, the pusher end portion of the push button is folded into the button receiving slot to align the button surface of the push button with the outer surface of the lighter casing so as to completely hide the push button in the button receiving slot within the lighter casing.

These and other objectives, features, and advantages of the present invention will become apparent from the following detailed description, the accompanying drawings, and the appended claims.

DETAILED DESCRIPTION OF THE PREFERRED EMBODIMENT

Figure 1:
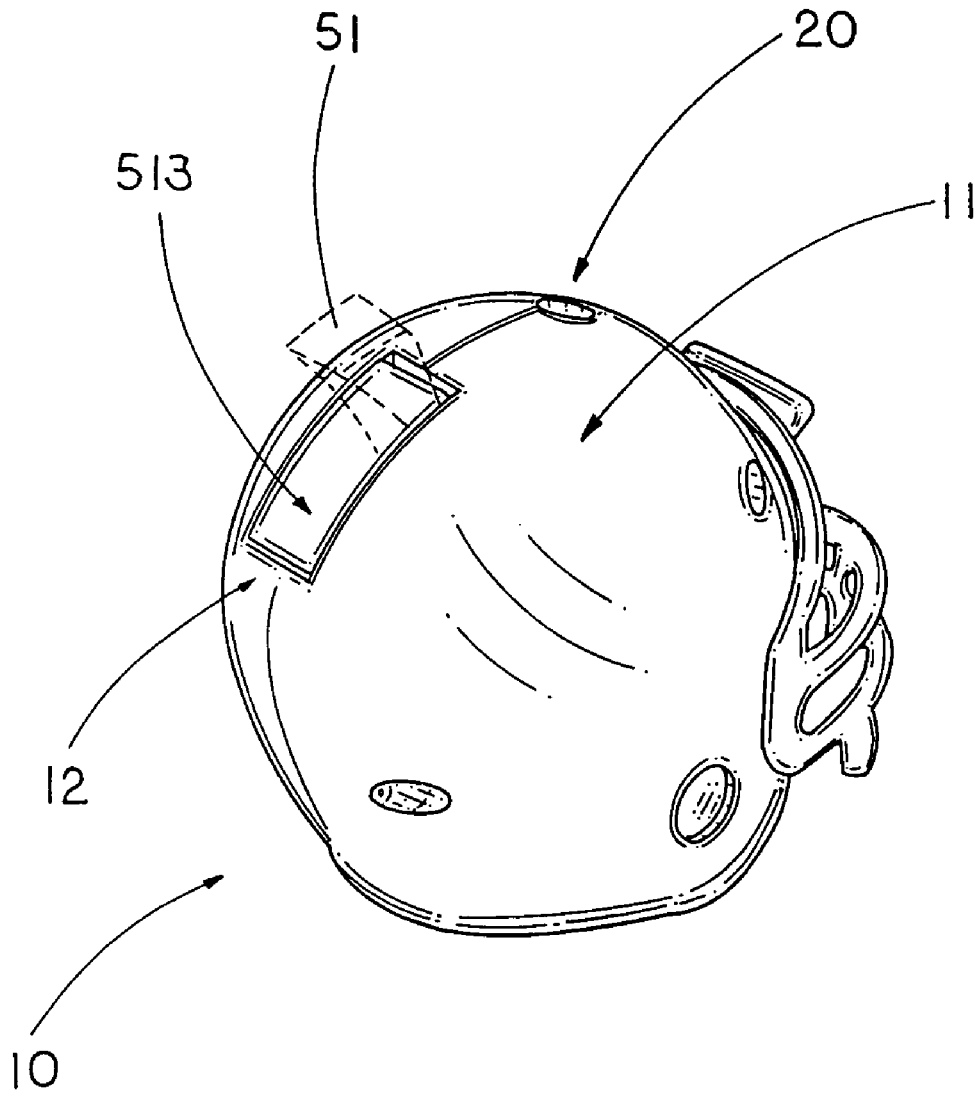
FIG. 1 is a perspective view of a piezoelectric lighter according to a preferred embodiment of the present invention.
Figure 2:
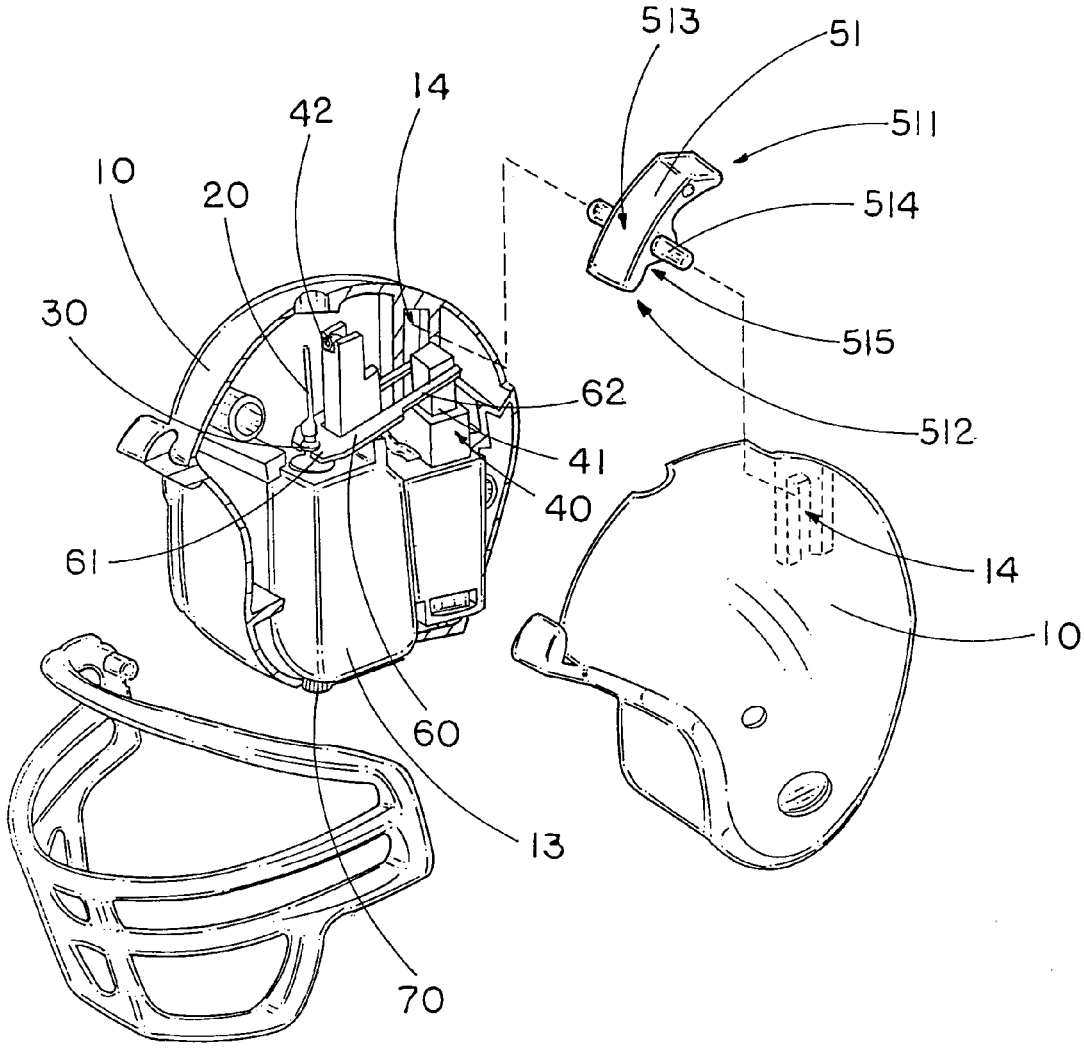
FIG. 2 is a exploded perspective view of the piezoelectric lighter according to the above preferred embodiment of the present invention.

Referring to FIG. 1 and FIG. 2 of the drawings, a piezoelectric lighter according to a preferred embodiment of the present invention is illustrated, in which the piezoelectric lighter comprises a lighter casing 10, an ignition nozzle 20, a gas releasing valve 30, a piezoelectric unit 40, and a push button arrangement.

The lighter casing 10 has an outer surface 11, a button receiving slot 12 indently formed on the outer surface 11, and a fuel storage compartment 13 provided in the lighter casing 10 for storing liquefied gaseous fuel.

The ignition nozzle 20 is communicatively extended from the fuel storage compartment 13 to the outer surface 11 of the lighter casing 10, wherein controlled ignition is fired from the ignition nozzle 20.

The gas releasing valve 30 communicates the fuel storage compartment 13 with the ignition nozzle 20 for controlling the gaseous fuel to release at the ignition nozzle 20 when the gas releasing valve 30 is uplifted.

The piezoelectric unit 40, which is received in the lighter casing 10, comprises a depressible part 41 extended upwardly, and a spark generation tip 42 extended towards the ignition nozzle 20 for generating a spark at the ignition nozzle 20 to ignite the gaseous fuel at the ignition nozzle 20 when the depressible part 41 is depressed.

The hidden push button arrangement comprises a push button 51 which has a pusher end portion 511, a pivot end portion 512 pivotally mounted at the lighter casing 11 at the button receiving slot 12 thereof, and a button surface 513 extended between the pusher end portion 511 and the pivot end portion 512, wherein the push button 51 is adapted to pivotally fold between an operation position and a hidden position.

Figure 4A:
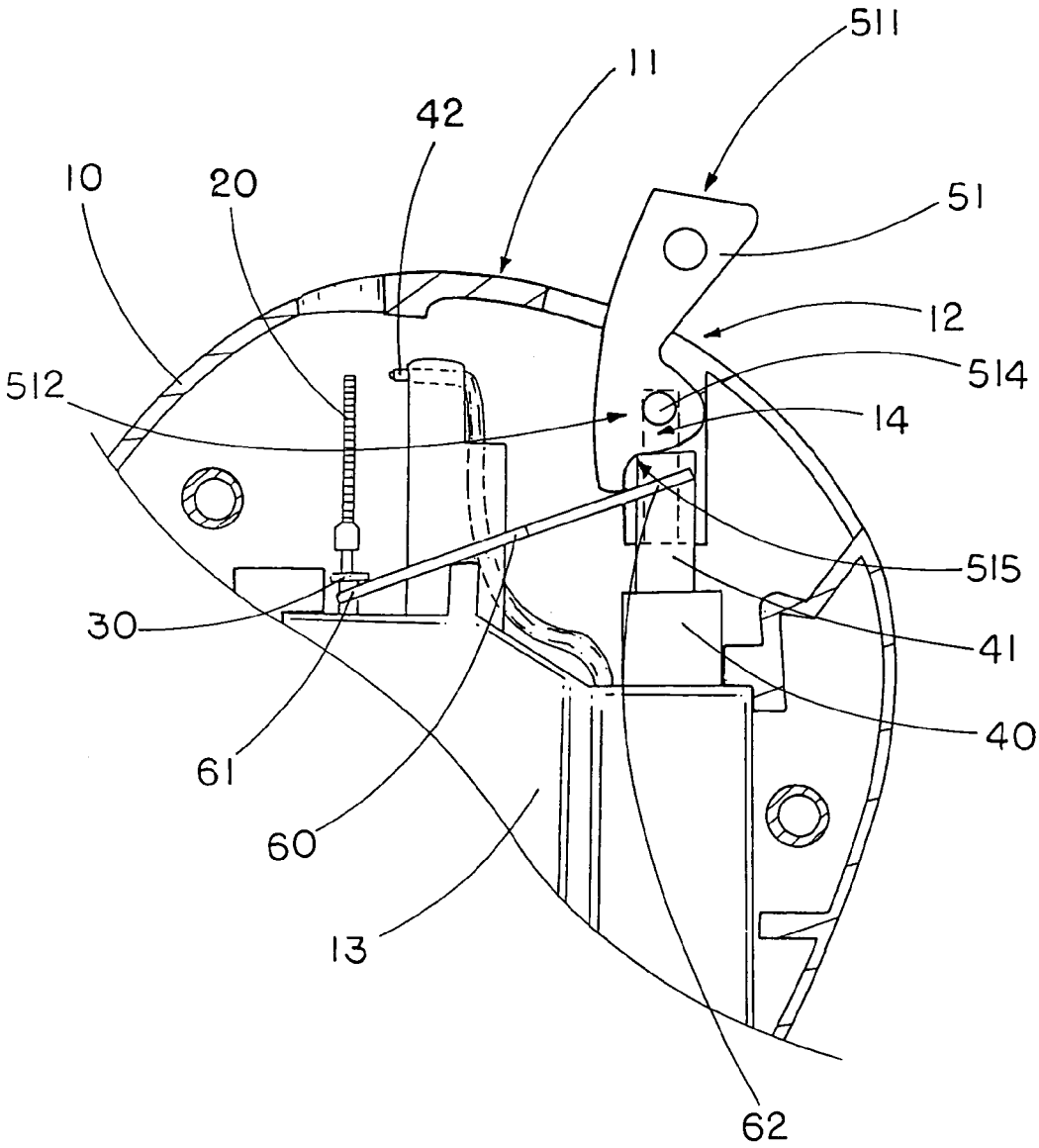
FIG. 4A and FIG. 4B are sectional side views of the piezoelectric lighter according to the above preferred embodiment of the present invention, illustrating that the push button is in operation position and when the push button is depressed respectively.
Figure 4B:
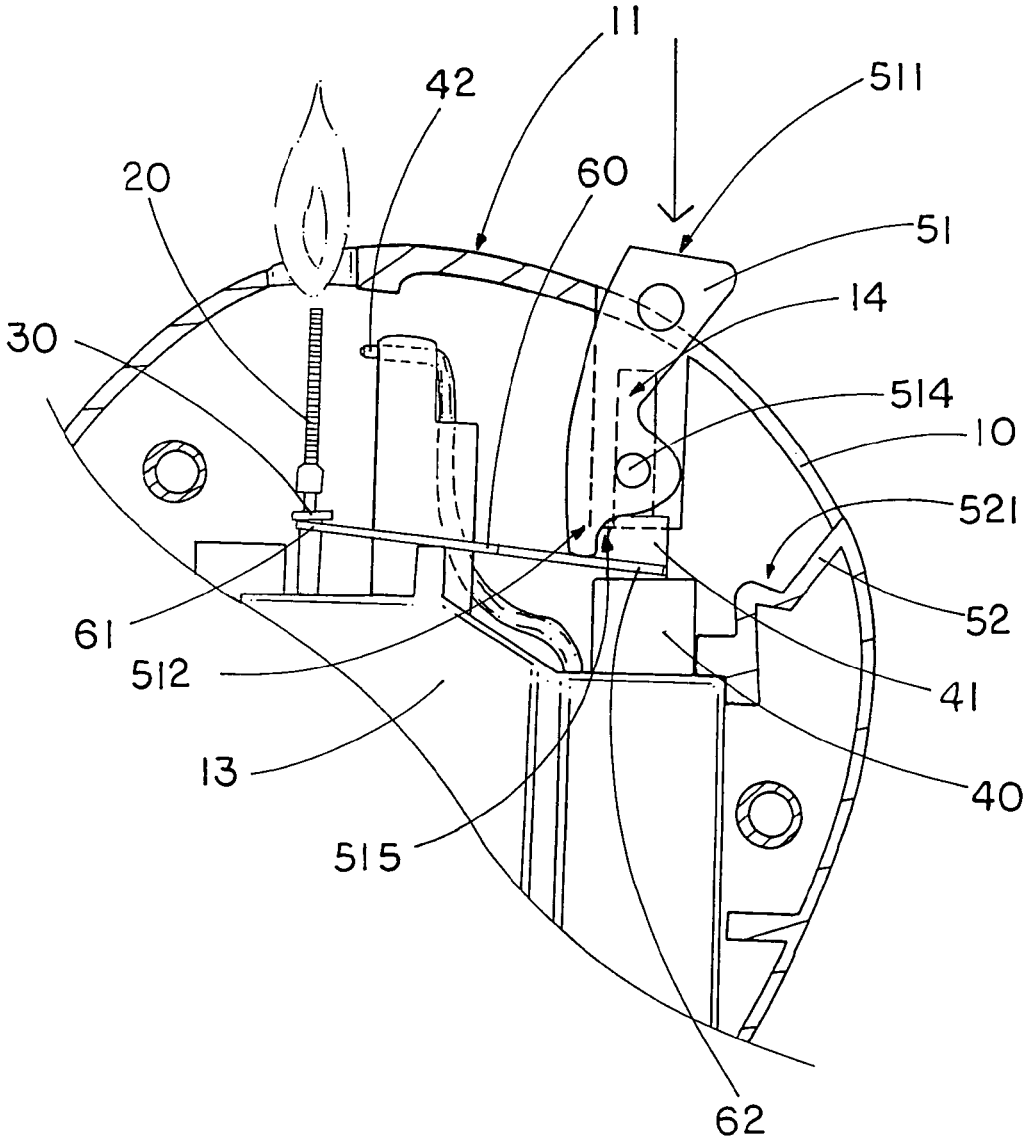

Referring to FIG. 4A and FIG. 4B of the drawings, when the push button 51 is at the operation position, the pusher end portion 511 of the push button 51 is upwardly folded above the outer surface 11 of the lighter casing 10 to align the pivot end portion 512 of the push button 51 with the depressible part 41 of the piezoelectric unit 40 such that the pusher end portion 511 of the push button 51 is adapted to be depressed to depress the depressible part 41 of the piezoelectric unit 40 for ignition at the ignition nozzle 20.

Figure 3:
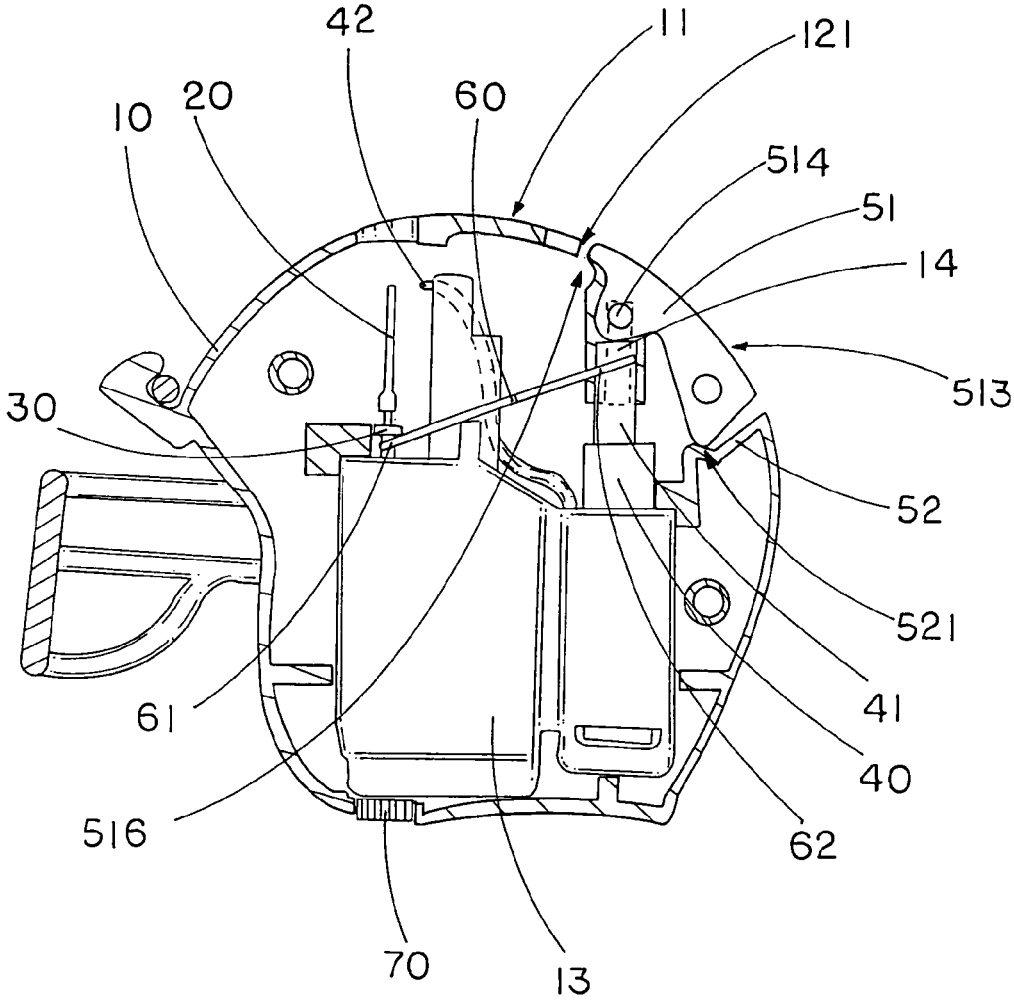
FIG. 3 is a sectional side view of the piezoelectric lighter according to the above preferred embodiment of the present invention, illustrating that the hidden push button is in the hidden position.

On the contrary, referring to FIG. 3 of the drawings, when the push button 51 is at the hidden position, the pusher end portion 511 of the push button 51 is folded into the button receiving slot 12 to align the button surface 513 of the push button 51 with the outer surface 11 of the lighter casing 10 so as to completely hide the push button 51 in the button receiving slot 12 within the lighter casing 10.

In order to ignite the piezoelectric lighter of the present invention, the piezoelectric lighter further comprises a gas lever 60 having an uplifting end 61 operatively engaged with the gas releasing valve 30, and an depression end 62 extended to align with a bottom end of the pivot end portion 512 of the push button 51, wherein when the pivot end portion 512 of the push button 51 is driven downwardly to depress the depressible part 41 of the piezoelectric unit 40, the depression end 62 of the gas lever 61 is simultaneously depressed downward to pivotally lift up the uplifting end 61 thereof so as to uplift the gas releasing valve 30 for releasing the gaseous fuel in the fuel storage compartment 13.

In other words, the gas lever 60 is pivotally connecting between the gas releasing valve 30 and the depressible part 41 of the piezoelectric unit 40 in such a manner that when the push button 51 is at the operation position and is depressed, the pivot end portion 512 will depress the depressible part 41 to generate a spark at the sparking generation tip 42, and at the same time depress the depression end 62 of the gas lever 60 so as to uplift the uplifting end 61 thereof in order to uplift the gas releasing valve 30 for releasing gaseous fuel at the ignition nozzle 20. As a result, the gaseous fuel released is ignited by the spark generated at the spark generation tip 42.

Referring to FIG. 2, FIG. 4A and FIG. 4B of the drawings, the lighter casing 10 further has two elongated guiding slots 14 downwardly formed therein from the outer surface 11 towards the depressible part 41 of the piezoelectric unit 40 to communicate with the button receiving slot 12, wherein the push button 51 further has two pivot shafts 514 transversely and integrally extended from two sides of the pivot end portions 512 to slidably engage with the two guiding slots 14 respectively so as to pivotally mount the push button 51 at the button receiving slot 12. In other words, the push button 51 is adapted to pivotally move between the operation position and the hidden position about the guiding slots 14.

Moreover, when the push button 51 is at the operation position, the two pivot shafts 514 are adapted to slidably move along the two guiding slots 14 so that the pivot end portion 512 is adapted to slidably move downwardly to depress the depressible part 41 of the piezoelectric unit 40 so as to ignite the piezoelectric lighter.

In other words, the two guiding slots 14 are downwardly extended from the outer surface 11 of the lighter casing 10 at a position that the depressible part 41 of the piezoelectric unit 40 is positioned between the two guiding slots 14 so as to guide the pivot end portion 512 of the push button 51 to depress the depressible part 41 of the piezoelectric lighter 40.

Conversely, when the hidden push button 51 is at the hidden position, it should not be able to depress for the sake of safety. Therefore, as shown in FIG. 3 of the drawings, the hidden push button arrangement further has a button stopper 52, having a blocking surface 521, formed at a bottom edge of the button receiving slot 12 and arranged in such a manner that when the push button 51 is folded in the button receiving slot 12, the pusher end portion 511 of the push button 51 is blocked at the blocking surface 521 of the button stopper 52 at a position that the button surface 513 of the push button 51 is aligned with the outer surface 11 of the lighter casing 10 while the push button 51 is blocked by the button stopper 52 to prevent the push button 51 from being depressed downwardly.

Referring to FIG. 1 of the drawings, the push button 51 is normally received in the button receiving slot 12 at the hidden position so that the button surface 513 is aligned to match with the outer surface 11 of the lighter casing 10. According to the preferred embodiment, the push button 51 is aesthetically crafted and designed to assimilate the outer surface 11 so as to be aesthetically in harmony with the entire lighter casing 10 in order to completely hide therwithin. For instances, the lighter casing 10 may be crafted and designed to form a helmet for pretending to be an ordinary accessory when it is not in use. As such, a person, unless properly notified or under careful scrutiny of the piezoelectric lighter of the present invention, is not able to easily discover where is the push button 51 and perform the relevant ignition. Furthermore, the lighter casing 10 as well as the push button 51 can be designed and crafted to become an aesthetically interesting object, so that people other than users of the present invention will prima facie recognized that such an object is not a lighter, but a regular accessory for decorative purpose.

Moreover, the lighter casing 10 and the button surface 513 of the push button 51 are preferably embodied as curved in shape and have the substantially same radius of curvature so as to align with each other when the push button 51 is at the hidden position, in such a manner that the push button 51 is adapted for easily and pivotally moved from the hidden position to the operation position by slightly pushing the pivotal end potion downwardly at the curved button surface 513.

This 'deceptive' feature is extremely important in the case of children, for the appearance of the lighter casing 10, if intentionally and properly designed, would ultimately misrepresent to them as a regular accessory rather than as a lighter which is capable of being ignited, thus preventing them to develop interest towards present invention. Even though the children somehow hold the piezoelectric lighter as a toy, the push button 51 would mean a minimum chance of children's exploitation into how to ignite the lighter at hand.

Referring to FIG. 3, FIG. 4A and FIG. 4B of the drawings, the push button 51 further has a retaining seat 515 formed at the pivot end portion 512 and arranged when the pusher end portion 511 of the push button 51 is upwardly folded above the outer surface 11 of the lighter casing 10, the retaining seat 515 would substantially sit on top of the depressible part 41 of the piezoelectric unit 40 so as to ensure that the depressible part 41 of the piezoelectric unit 40 to be depressed when the pusher end portion 511 of the push button 51 is depressed downwardly.

Moreover, according to the preferred embodiment of the present invention, the retaining seat 515 is formed as L-shape such that when the push button 51 is at the operation position, the depressible part 41 of the piezoelectric unit 40 is received within the L-shape retaining seat 515 so as to be restricted pivotal movement of the push button 51. In other words, the retaining seat 515 is adapted to retain the push button 51 in the operation position.

Referring to FIG. 3 of the drawings, in order to further enhance the convenience of operating the present invention, the pivot end portion 512 of the push button 51 is pivotally mounted in the button receiving slot 12 in such a manner to define an actuation clearance 516 between the pivot end portion 512 and corresponding sidewall 121 of the button receiving slot 12, wherein the user is able to slightly and easily press down the pivotal end potion 512 of the push button 51 so as to pivotally move it between the operation position and the hidden position.

In other words, the actuation clearance 516 is formed between the pivot end portion 512 of the push button 51 and a corresponding sidewall 121 of the button receiving slot 12 when the push button 51 is hidden therewithin to allow the pivot end portion 512 of the push button 51 to pivotally fold into the button receiving slot 12 at a position on top of the depressible part 41 of the piezoelectric unit 40.

In order to control the severity of fire generated, the piezoelectric lighter may further comprise a fuel release controller operatively provided at the bottom of the fuel storage compartment 13 and communicated with the outer case 10 so that a user is able to tune a flow rate of the gaseous fuel releasing out from the fuel storage compartment 13 through the gas releasing valve 30 so as to control a severity of the resulting fire generated.

Moreover, as shown in FIG. 2 of the drawings, the piezoelectric lighter further comprises a fuel injection inlet 70 provided at a bottom of the fuel storage compartment 13 and communicated with the outer case 10 for connecting with an external gaseous fuel for refueling of the liquefied gaseous fuel inside the fuel storage compartment 13. As such, although the outer case 10 is aesthetically embodied as not to be a lighter, the essential features of a conventional lighter are still provided for informed users of the present invention.

From the forgoing descriptions, it can be shown that the above mentioned objects are substantially accomplished. The piezoelectric lighter of the present invention prevents it to be recognized as a lighter by the virtue of its aesthetic appearance, and comprises safety measures to prevent accidental ignition. Moreover, the push button 51 can be easily switched to the operation position for ignition. It is worth mentioning that the lighter casing 10 may be specifically crafted not to be interested among ordinary children so as not to attract their attention in the first place for minimizing the chance of them contacting the piezoelectric lighter.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A piezoelectric lighter, comprising:

a lighter casing which has an outer curved surface, a button receiving slot indently formed on said outer curved surface, and a fuel storage compartment provided in said lighter casing for storing liquefied gaseous fuel;

an ignition nozzle communicatively extended from said fuel storage compartment to said outer surface of said lighter casing;

a gas releasing valve communicated said fuel storage compartment with said ignition nozzle for controlling said fuel to release at said ignition nozzle when said gas releasing valve is uplifted;

a piezoelectric unit, which is received in said lighter casing, comprising a depressible part extended upwardly and a spark generation tip towards said ignition nozzle for generating a spark at said ignition nozzle to ignite said fuel at said ignition nozzle when said depressible part is depressed; and a push button arrangement, which comprises:

a push button, having a pusher end portion, a pivot end portion pivotally mounted at said lighter casing at said button receiving slot thereof, and a curved button surface extended from said pusher end portion and said pivot end portion, wherein said curved button surface of said push button has a curvature corresponding to a curvature of said outer curved surface of said lighter casing to assimilate said outer surface to be aesthetically in harmony with said lighter casing as an integral outer surface thereof, wherein said push button is adapted to pivotally fold between an operation position and a hidden position, wherein at said operation position, said pusher end portion of said push button is upwardly folded above said outer curved surface of said lighter casing to align said pivot end portion of said push button with said depressible part of said piezoelectric unit such that said pusher end portion of said push button is adapted to be depressed to depress said depressible part of said piezoelectric unit and to lift up said gas releasing valve for ignition, and at said hidden position, said pusher end portion of said push button is pivotally folded into said button receiving slot to align said curved button surface of said push button with said outer curved surface of said lighter casing so as to completely hide said push button in said button receiving slot within said lighter casing.

2. The piezoelectric lighter, as recited in claim 1, wherein said push button further has a L-shaped retaining seat formed at said pivot end portion and arranged when said pusher end portion of said push button is upwardly folded above said outer curved surface of said lighter casing, said retaining seat substantially sits on top of said depressible part of said piezoelectric unit to ensure said depressible part of said piezoelectric unit to be depressed when said pusher end portion of said push button is depressed downwardly and to restrict a further pivotal movement of said push button.

3. The piezoelectric lighter, as recited in claim 1, wherein said hidden push button arrangement further has a button stopper, having a blocking surface, formed at a bottom edge of said button receiving slot and arranged in such a manner that when said push button is folded in said butting receiving slot, said pusher end of said push button is blocked at said blocking surface of said button stopper at a position that said curved button surface of said push button is aligned with said outer curved surface of said lighter casing while said push button is blocked by said button stopper to prevent said push button from being depressed downwardly.

4. The piezoelectric lighter, as recited in claim 2, wherein said hidden push button arrangement further has a button stopper, having a blocking surface, formed at a bottom edge of said button receiving slot and arranged in such a manner that when said push button is folded in said butting receiving slot, said pusher end of said push button is blocked at said blocking surface of said button stopper at a position that said curved button surface of said push button is aligned with said outer curved surface of said lighter casing while said push button is blocked by said button stopper to prevent said push button from being depressed downwardly.

5. The piezoelectric lighter, as recited in claim 1, wherein an actuation clearance is formed between said pivot end portion of said push button and a corresponding sidewall of said button receiving slot when said push button is hidden therewithin to not only allow said pivot end portion of said push button to pivotally fold into said button receiving slot at a position on top of said depressible part of said piezoelectric unit but also permit said pivot end portion of said push button being downwardly pressed to pivotally lift up said pusher end portion of said push button tram said outer curved surface of said lighter casing.

6. The piezoelectric lighter, as recited in claim 2, wherein an actuation clearance is formed between said pivot end portion of said push button and a corresponding sidewall of said button receiving slot when said push button is hidden therewithin to not only allow said pivot end portion of said push button to pivotally fold into said button receiving slot at a position on top of said depressible part of said piezoelectric unit but also permit said pivot end portion of said push button being downwardly pressed to pivotally lift up said pusher end portion of said push button from said outer curved surface of said lighter casing.

7. The piezoelectric lighter, as recited in claim 4, wherein an actuation clearance is formed between said pivot end portion of said push button and a corresponding sidewall of said button receiving slot when said push button is hidden therewithin to not only allow said pivot end portion of said push button to pivotally fold into said button receiving slot at a position on top of said depressible part of said piezoelectric unit but also permit said pivot end portion of said push button being downwardly pressed to pivotally lift up said pusher end portion of said push button from said outer curved surface of said lighter casing.

8. The piezoelectric lighter, as recited in claim 4, wherein said hidden push button arrangement further has two elongated guiding slots downwardly extended from said outer curved surface of said lighter casing towards said depressible part of said piezoelectric unit to communicate with said button receiving slot, and comprises two pivot shafts sidewardly extended from two sides of said pivot end portion of said push button to slidably engage with said guiding slots respectively so as to pivotally mount said push button at said button receiving slot such that when said pusher end portion of said push button is upwardly folded above said outer curved surface of said lighter casing, said two pivot shafts respectively slid along said guiding slots to guide said push button to depress said depressible part of said piezoelectric unit.

9. The piezoelectric lighter, as recited in claim 7, wherein said hidden push button arrangement further has two elongated guiding slots downwardly extended from said outer curved surface of said lighter casing towards said depressible part of said piezoelectric unit to communicate with said button receiving slot, and comprises two pivot shafts sidewardly extended from two sides of said pivot end portion of said push button to slidably engage with said guiding slots respectively so as to pivotally mount said push button at said button receiving slot such that when said pusher end portion of said push button is upwardly folded above said outer curved surface of said lighter casing, said two pivot shafts respectively slid along said guiding slots to guide said push button to depress said depressible part of said piezoelectric unit.

10. The piezoelectric lighter, as recited in claim 8, wherein said two guiding slots are downwardly extended from said outer curved surface of said lighter casing at a position that said depressible part of said piezoelectric unit is positioned between said two guiding slots so as to guide said pivot end portion of said push button to depress said depressible part of said piezoelectric lighter.

11. The piezoelectric lighter, as recited in claim 9, wherein said two guiding slots are downwardly extended from said outer curved surface of said lighter casing at a position that said depressible part of said piezoelectric unit is positioned between said two guiding slots so as to guide said pivot end portion of said push button to depress said depressible part of said piezoelectric lighter.

12. The piezoelectric lighter, as recited in claim 4, further comprising a gas lever having an uplifting end operatively engaged with said gas releasing valve, and a depression end extended to align with a bottom end of said pivot end portion of said push button, wherein when said pivot end portion of said push button is driven downwardly to depress said depressible part of said piezoelectric unit, said depression end of said gas lever is simultaneously depressed downward to pivotally lift up said uplifting end thereof so as to uplift said gas releasing valve for releasing said fuel.

13. The piezoelectric lighter, as recited in claim 7, further comprising a gas lever having an uplifting end operatively engaged with said gas releasing valve, and a depression end extended to align with a bottom end of said pivot end portion of said push button, wherein when said pivot end portion of said push button is driven downwardly to depress said depressible part of said piezoelectric unit, said depression end of said gas lever is simultaneously depressed downward to pivotally lift up said uplifting end thereof so as to uplift said gas releasing valve for releasing said fuel.

14. The piezoelectric lighter, as recited in claim 11, further comprising a gas lever having an uplifting end operatively engaged with said gas releasing valve, and a depression end extended to align with a bottom end of said pivot end portion of said push button, wherein when said pivot end portion of said push button is driven downwardly to depress said depressible part of said piezoelectric unit, said depression end of said gas lever is simultaneously depressed downward to pivotally lift up said uplifting end thereof so as to uplift said gas releasing valve for releasing said fuel.

* * * * *